US011779794B2

(12) United States Patent
Martinez et al.

(10) Patent No.: US 11,779,794 B2
(45) Date of Patent: Oct. 10, 2023

(54) PHYSICAL EXERCISE ASSEMBLY

(71) Applicants: Alan Martinez, Littleton, CO (US); Laura Martinez, Littleton, CO (US)

(72) Inventors: Alan Martinez, Littleton, CO (US); Laura Martinez, Littleton, CO (US)

( * ) Notice: Subject to any disclaimer, the term of this patent is extended or adjusted under 35 U.S.C. 154(b) by 0 days.

(21) Appl. No.: 17/683,461

(22) Filed: Mar. 1, 2022

(65) Prior Publication Data

US 2023/0277891 A1 Sep. 7, 2023

(51) Int. Cl.
*A63B 21/00* (2006.01)
*A63B 21/055* (2006.01)

(52) U.S. Cl.
CPC ..... *A63B 21/156* (2013.01); *A63B 21/0552* (2013.01); *A63B 21/4013* (2015.10); *A63B 21/4029* (2015.10); *A63B 21/4035* (2015.10)

(58) Field of Classification Search
CPC ..... A63B 21/156; A63B 21/00185; A63B 21/4013; A63B 21/4029; A63B 21/00047; A63B 21/02; A63B 21/028; A63B 21/0442; A63B 21/055–0557; A63B 21/1609; A63B 21/1672; A63B 21/4015; A63B 21/4019; A63B 21/4021; A63B 21/4033–4035; A63B 21/154; A63B 69/10; A63B 2244/20
See application file for complete search history.

(56) References Cited

U.S. PATENT DOCUMENTS

| | | | | |
|---|---|---|---|---|
| 5,545,114 | A | 8/1996 | Gvoich | |
| 5,569,138 | A | 10/1996 | Wang | |
| D406,290 | S | 3/1999 | McBride | |
| 6,544,154 | B2 | 4/2003 | Forcillo | |
| 7,128,700 | B2 | 10/2006 | Wallach | |
| 7,601,109 | B2 * | 10/2009 | Roumayah | A63B 23/0211 482/142 |
| 9,211,433 | B2 * | 12/2015 | Hall | A63B 22/203 |
| 9,592,420 | B2 * | 3/2017 | Noyes | A63B 21/4029 |
| 9,901,502 | B2 * | 2/2018 | Rosario, Jr. | A63B 21/4034 |
| 2004/0014570 | A1 | 1/2004 | Centopani | |

* cited by examiner

*Primary Examiner* — Loan B Jimenez
*Assistant Examiner* — Kathleen M Fisk

(57) ABSTRACT

A physical exercise assembly includes a table that is substantially elongated to accommodate a user lying on the table. A cable support is spaced below the table and a bracket is coupled to the cable support. A plurality of pulleys is rotatably coupled to the cable support. A pair of first bands is coupled to the bracket and extends around respective ones of the pulleys. A pair of handles is each coupled to a respective one of the first bands for gripping and exercising arms. A pair of second bands is each coupled to the bracket and extends around respective ones of the pulleys. A pair of ankle straps is each coupled to a respective one of the second bands for exercising legs.

8 Claims, 3 Drawing Sheets

PHYSICAL EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for facilitating a full body exercise with resistance training. The device includes a table with a plurality of pulleys disposed on a cable support that is spaced beneath the table. The device includes a set of first bands and a set of second bands that each extend around respective pulleys. A pair of handles is attached to the first bands and a pair of ankle straps is coupled to the second bands for exercising arms and legs. Each of the first bands and the second bands are resiliently stretchable.

(2) Description of Related Art Including Information Disclosed Under 37 CFR 1.97 and 1.98

The prior art relates to exercise devices including an exercise device comprising a hinged table, handlebars and foot pegs. The prior art discloses an exercise chair which includes pivoting resistance arms. The prior art discloses an abdominal exercise bench with adjustable resistance. The prior art discloses an exercise chair with a plurality of resistance bands. The prior art discloses an exercise bench with a pair of pivoting arms and resistance bands attached to the pivoting arms. The prior art discloses a workout bench with a pair of resistance bands fixed to the workout bench.

(h) BRIEF SUMMARY OF THE INVENTION

An embodiment of the disclosure meets the needs presented above by generally comprising a table that is substantially elongated to accommodate a user lying on the table. A cable support is spaced below the table and a bracket is coupled to the cable support. A plurality of pulleys is rotatably coupled to the cable support. A pair of first bands is coupled to the bracket and extends around respective ones of the pulleys. A pair of handles is each coupled to a respective one of the first bands for gripping and exercising arms. A pair of second bands is each coupled to the bracket and extends around respective ones of the pulleys. A pair of ankle straps is each coupled to a respective one of the second bands for exercising legs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
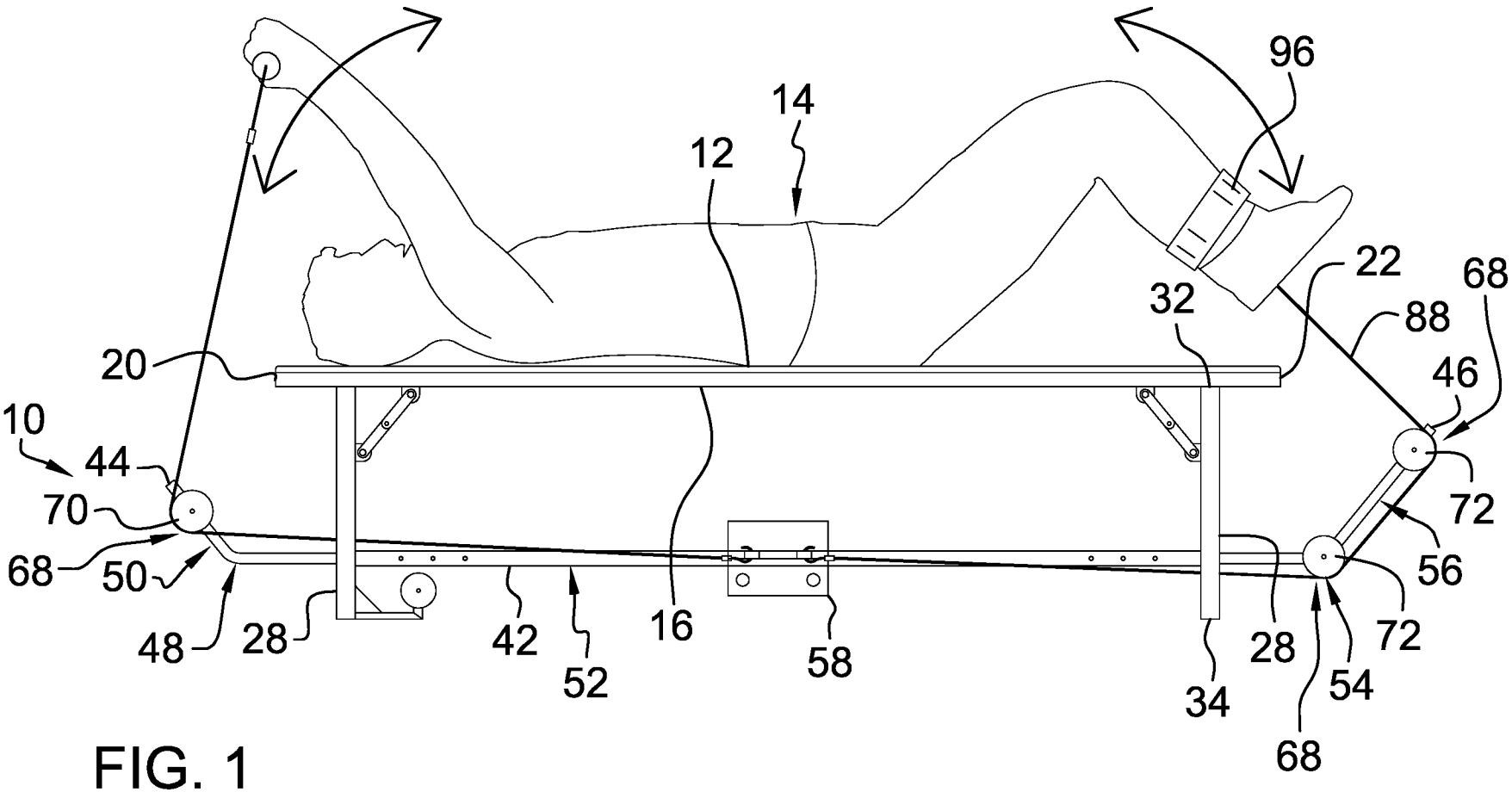
FIG. 1 is a perspective in-use view of a physical exercise assembly according to an embodiment of the disclosure.
Figure 3:
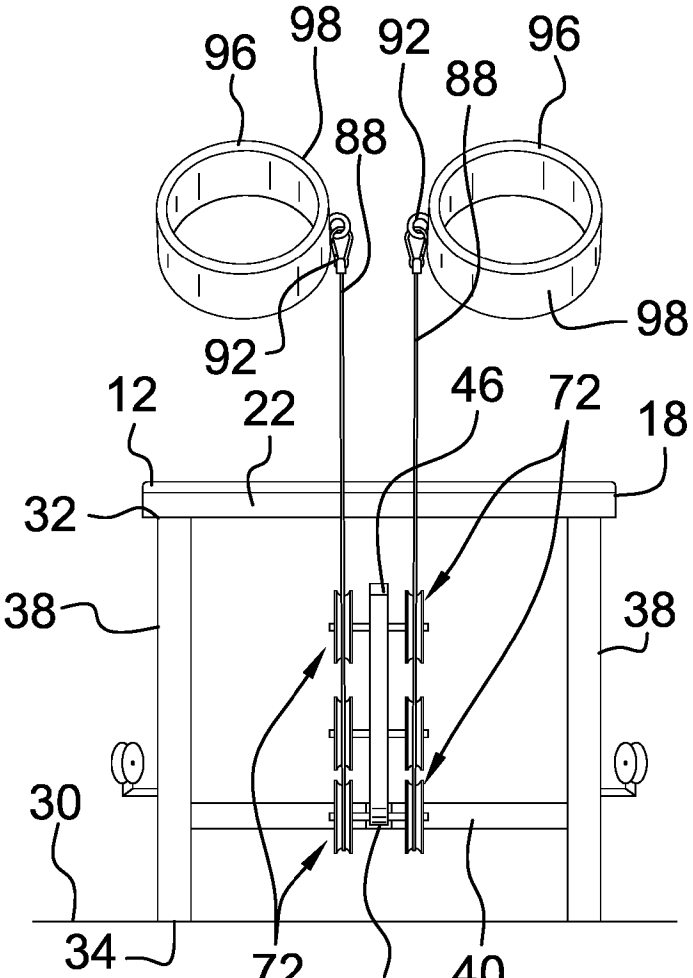
FIG. 3 is a back view of an embodiment of the disclosure.
Figure 2:
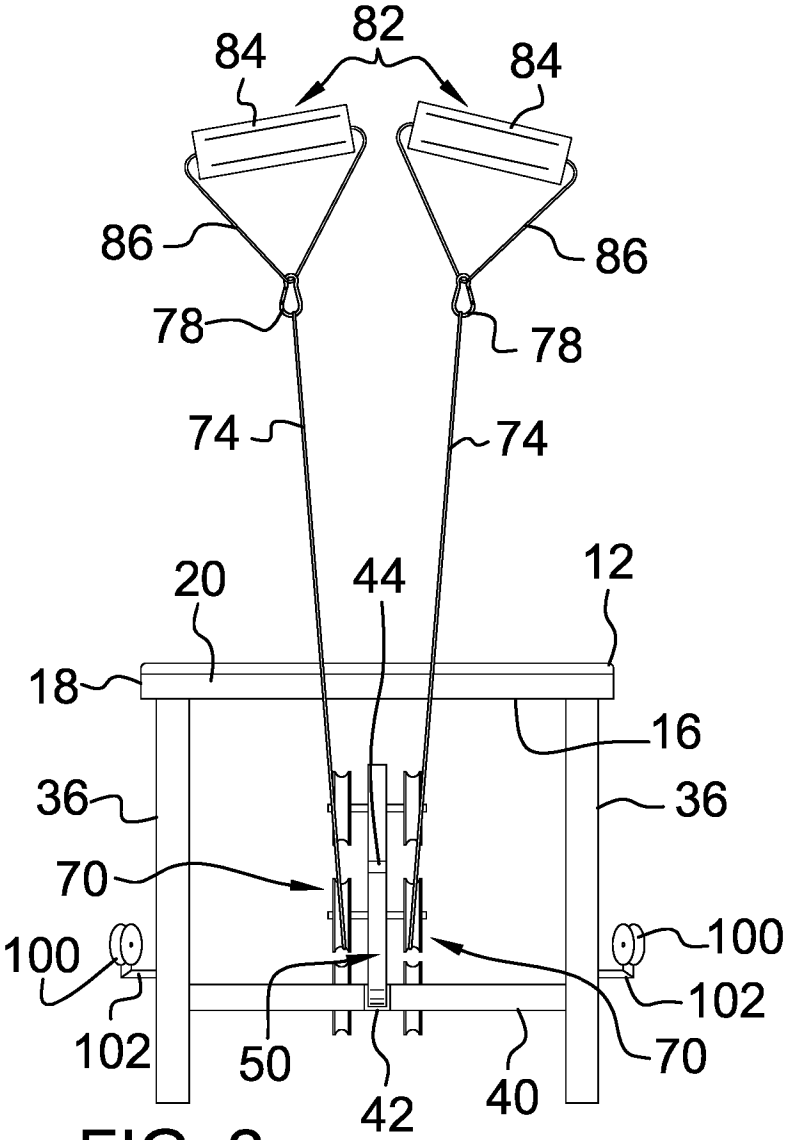
FIG. 2 is a front view of an embodiment of the disclosure.
Figure 4:
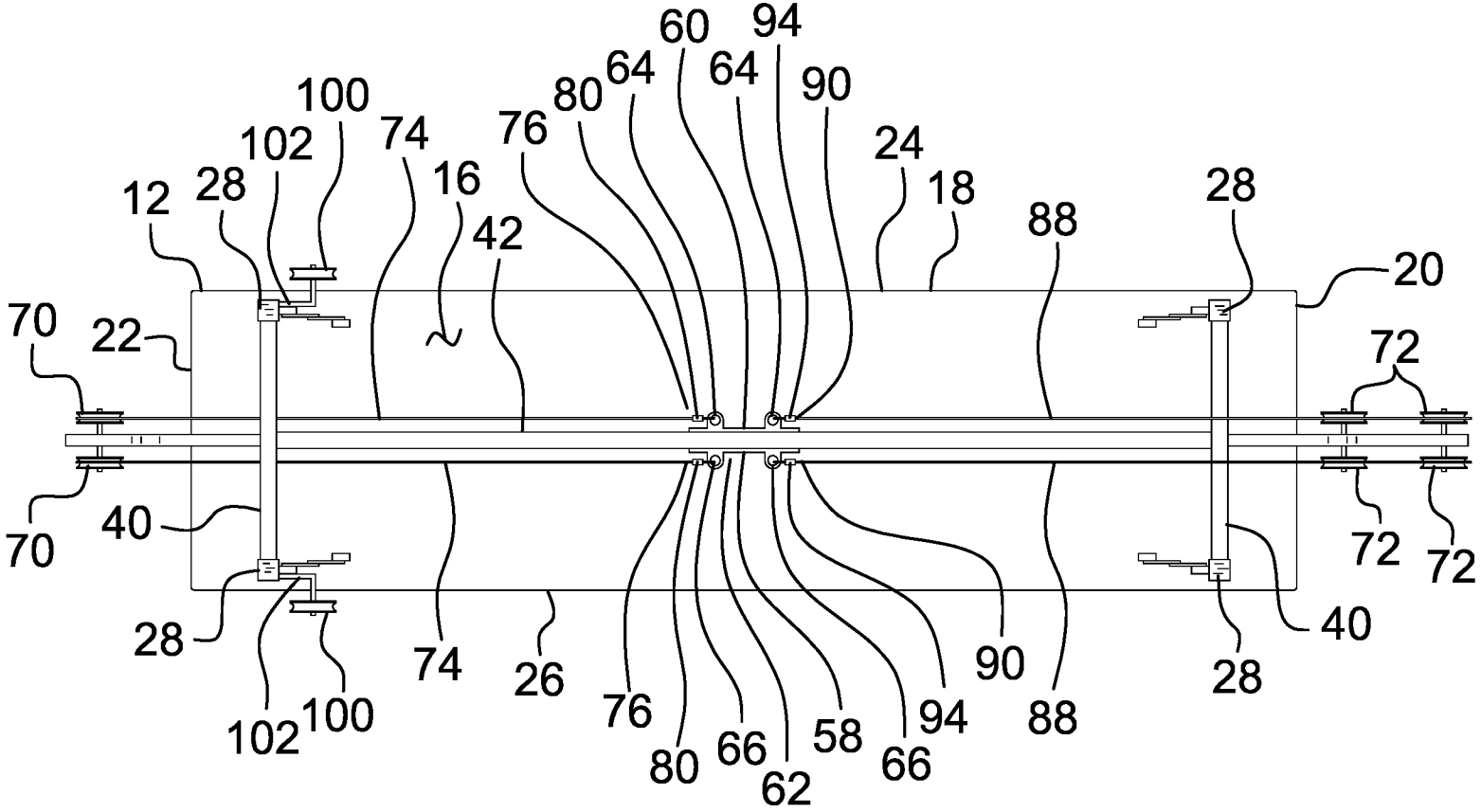
FIG. 4 is a bottom view of an embodiment of the disclosure.

With reference now to the drawings, and in particular to FIGS. 1 through 4 thereof, a new exercise device embodying the principles and concepts of an embodiment of the disclosure and generally designated by the reference numeral 10 will be described.

As best illustrated in FIGS. 1 through 4, the physical exercise assembly 10 generally comprises a table 12 that is substantially elongated to accommodate a user 14 lying on the table 12. The table 12 has a bottom surface 16 and a perimeter edge 18, and the perimeter edge 18 has a front side 20, a back side 22, a first lateral side 24 and a second lateral side 26, and the table 12 is elongated between the front side 20 and the back side 22. The table 12 may include cushioning on top of the table 12 for enhancing comfort for the user 14. A plurality of legs 28 is each coupled to the table 12 for supporting the table 12 over a support surface 30. Each of the legs 28 has an upper end 32 and a lower end 34, and the upper end 32 of each of the legs 28 is coupled to the bottom surface 16 of the table 12.

The plurality of legs 28 includes a set of front legs 36 and a set or rear legs 38. Each of the front legs 36 is positioned adjacent to the front side 20 of the perimeter edge 18 of the table 12. Each of the rear legs 38 is positioned adjacent to the back side 22 of the perimeter edge 18 of the table 12. A pair of cross members 40 is each coupled to and extends between a respective set of the front legs 36 and rear legs 38.

Each of the cross members 40 is positioned between the upper end 32 and the lower end 34 of the respective front legs 36 and rear legs 38.

A cable support 42 is coupled to each of the plurality of legs 28 such that the cable support 42 is spaced below the table 12. The cable support 42 has a first end 44 and a second end 46, and the cable support 42 is elongated between the first end 44 and the second end 46. The cable support 42 has a first bend 48 that is spaced from the first end 44 to define a first end portion 50 of the cable support 42 forming an angle with a central portion 52 of the cable support 42. The cable support 42 has a second bend 54 that is spaced from the second end 46 to define a second end portion 56 of the cable support 42 forming an angle with the central portion 52. The central portion 52 is coupled to each of the cross members 40 such that each of the first end portion 50 and the second end portion 56 angle upwardly toward a respective one of the front side 20 and the back side 22 of the perimeter edge 18 of the table 12. Furthermore, the central portion 52 of the cable support 42 lies on a plane that is oriented parallel to the bottom surface 16 of the table 12. The central portion 52 may be divided into a plurality of slidable sections such that the central portion 52 has a telescopically adjustable length.

A bracket 58 is provided which has a first lateral side 60 and a second lateral side 62, and the bracket 58 is integrated into the central portion 52 of the cable support 42. The bracket 58 has a pair of first engagements 64 each disposed on the first lateral side 60, and the bracket 58 has a pair of second engagements 66 each disposed on the second lateral side 62. The bracket 58 is centrally positioned between the first bend 48 and the second bend 54 on the cable support 42.

A plurality of pulleys 68 is each rotatably coupled to the cable support 42 and the pulleys 68 are distributed on opposing ends of the cable support 42. The plurality of pulleys 68 includes a set of first pulleys 70 and a set of second pulleys 72. Each of the first pulleys 70 is positioned on opposing sides of the first end portion 50 of the cable support 42 from each other, and each of the first pulleys 70 is positioned adjacent to the first end 44 of the cable support 42. Each of the second pulleys 72 is positioned on opposing sides of the second end portion 56 of the cable support 42 from each other. Additionally, the second pulleys 72 are spaced apart from each other and are distributed between the second bend 54 and the second end 46.

A pair of first bands 74 is each coupled to the bracket 58 and each of the first bands 74 extends around respective ones of the first pulleys 70. Each of the first bands 74 is comprised of a resiliently stretchable material and each of the first bands 74 has a first end 76 and a second end 78. A pair of first couplers 80 is each coupled to the first end 76 of a respective one of the first bands 74. Each of the first couplers 80 releasably engages a respective one of the first engagements 64 and a respective one of the second engagements 66 on the bracket 58.

A pair of handles 82 is provided and each of the handles 82 is coupled to a respective one of the first bands 74. Each of the handles 82 can be gripped with the user's hands thereby facilitating the user 14 to exercise their arms by stretching the first bands 74. Each of the handles 82 has a grip 84 and a yoke 86, and the yoke 86 of each of the handles 82 is releasably coupled to the second end 78 of the respective first band 74 such that the grip 84 is perpendicularly oriented with the respective first band 74.

A pair of second bands 88 is each coupled to the bracket 58 and each of the second bands 88 extends around respective ones of the second pulleys 72. Each of the second bands 88 is comprised of a resiliently stretchable material, and each of the second bands 88 has a first end 90 and a second end 92. A pair of second couplers 94 is each coupled to the first end 90 of a respective one of the second bands 88. Each of the second couplers 94 releasably engages a respective one of the first engagements 64 and a respective one of the second engagements 66 on the bracket 58. A pair of ankle straps 96 is provided and each of the ankle straps 96 is coupled to a respective one of the second bands 88. Each of the ankle straps 96 can be worn around a respective one of the user's ankles thereby facilitating the user 14 to exercise their legs with the second bands 88. Each of the ankle straps 96 has an outer surface 98 and the second end 92 of a respective one of the second bands 88 is releasably coupled to the outer surface 98.

A pair of swivel pulleys 100 is each disposed on a respective one of the legs 28. Additionally, each of the first bands 74 is selectively extendable around the swivel pulleys 100 for adjusting a route taken by the first bands 74. In this way the first bands 74 can be drawn laterally across the user's body, rather than being drawn lengthwise along the user's body. Each of the swivel pulleys 100 includes a mount 102 which extends laterally away from a respective one of the cross members 40 such that each of the swivel pulleys 100 is spaced outwardly beyond a respective one of the first lateral side 24 and the second lateral side 26 of the perimeter edge 18 of the table 12. Additionally, the mount 102 is pivotable 12 on the respective cross member 40 for positioning at a variety of angles on the respective cross member 40.

In use, the user 14 lies on the table 12, each of the ankle straps 96 is worn around a respective one of the user's ankles and each of the handles 82 is gripped. In this way the user 14 can exercise their arms and their legs by pulling against the resistance of the first bands 74 and the second bands 88. Additionally, the first bands 74 can be routed around the swivel pulleys 100 to facilitate the first bands 74 to drawn laterally across the user's body. In this way the first bands 74 and the second bands 88 facilitate the user 14 to perform a wide variety of exercises with resistance training.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A physical exercise assembly for facilitating a user to exercise their entire body with resistance training, said assembly comprising:

a table being substantially elongated wherein said table is configured to accommodate a user lying on said table;

a plurality of legs, each of said legs being coupled to said table wherein said plurality of legs is configured to support said table over a support surface;

a cable support being coupled to each of said plurality of legs such that said cable support is spaced below said table;

a bracket being coupled to said cable support;

a plurality of pulleys, each of said pulleys being rotatably coupled to said cable support, said pulleys being distributed on opposing ends of said cable support;

a pair of first bands, each of said first bands being coupled to said bracket, each of said first bands extending around respective ones of said pulleys, each of said first bands being comprised of a resiliently stretchable material;

a pair of handles, each of said handles being coupled to a respective one of said first bands wherein each of said handles is configured to be gripped with the user's hands thereby facilitating the user to exercise their arms by stretching said first bands;

a pair of second bands, each of said second bands being coupled to said bracket, each of said second bands extending around respective ones of said pulleys, each of said second bands being comprised of a resiliently stretchable material;

a pair of ankle straps, each of said ankle straps being coupled to a respective one of said second bands wherein each of said ankle straps is configured to be worn around a respective one of the user's ankles thereby facilitating the user to exercise their legs with said second bands; and a pair of swivel pulleys, each of said swivel pulleys being disposed on a respective one of said legs, each of said first bands being selectively extendable around said swivel pulleys for adjusting a route taken by said first bands.

2. The assembly according to claim 1, wherein:

said table has a bottom surface and a perimeter edge, said perimeter edge having a front side, a back side, a first lateral side and a second lateral side, said table being elongated between said front side and said back side;

each of said legs has an upper end and a lower end, said upper end of each of said legs being coupled to said bottom surface of said table, said plurality of legs including a set of front legs and a set of rear legs, each of said front legs being positioned adjacent to said front side of said perimeter edge of said table, each of said rear legs being positioned adjacent to said back side of said perimeter edge of said table;

said assembly includes a pair of cross members, each of said cross members being coupled to and extending between a respective set of said front legs and rear legs, each of said cross members being positioned between said upper end and said lower end of said respective front legs and rear legs; and said cable support has a first end and a second end, said cable support being elongated between said first end and said second end, said cable support having a first bend being spaced from said first end to define a first end portion of said cable support forming an angle with a central portion of said cable support, said cable support having a second bend being spaced from said second end to define a second end portion of said cable support forming an angle with said central portion, said central portion being coupled to each of said cross members such that each of said first end portion and said second end portion angle upwardly toward a respective one of said front side and said back side of said perimeter edge of said table, said central portion of said cable support lying on a plane being oriented parallel to said bottom surface of said table.

3. The assembly according to claim 2, wherein:

said plurality of pulleys includes a set of first pulleys and a set of second pulleys;

each of said first pulleys is positioned on opposing sides of said first end portion of said cable support from each other, each of said first pulleys being positioned adjacent to said first end of said cable support; and each of said second pulleys is positioned on opposing sides of said second end portion of said cable support from each other, said second pulleys being spaced apart from each other and being distributed between said second bend and said second end.

4. The assembly according to claim 3, wherein:

each of said first bands having a first end and a second end, each of said first bands extending around a respective one of said first pulleys;

said assembly includes a pair of first couplers, each of said first couplers being coupled to said first end of a respective one of said first bands, each of said first couplers releasably engaging a respective one of a first engagement and a respective one of a second engagement on said bracket; and each of said handles has a grip and a yoke, said yoke of each of said grips being releasably coupled to said second end of said respective first band such that said grip is perpendicularly oriented with said respective first band.

5. The assembly according to claim 3, wherein:

each of said second bands having a first end and a second end, each of said second bands extending around respective ones of said second pulleys;

said assembly includes a pair of first couplers and a pair of second couplers, each of said second couplers being coupled to said first end of a respective one of said second bands, each of said second couplers releasably engaging a respective one of a first engagement and a respective one of a second engagement on said bracket; and each of said ankle straps has an outer surface, said second end of a respective one of said second bands being releasably coupled to said outer surface.

6. The assembly according to claim 2, wherein said bracket has a first lateral side and a second lateral side, said bracket being integrated into said central portion of said cable support, said bracket having a pair of first engagements each being disposed on said first lateral side, said bracket having a pair of second engagements each being disposed on said second lateral side, said bracket being centrally positioned between said first bend and said second bend on said cable support.

7. The assembly according to claim 2, wherein each of said swivel pulleys includes a mount extending laterally away from a respective one of said cross members such that each of said swivel pulleys is spaced outwardly beyond a respective one of said first lateral side and said second lateral side of said perimeter edge of said table.

8. A physical exercise assembly for facilitating a user to exercise their entire body with resistance training, said assembly comprising:

a table being substantially elongated wherein said table is configured to accommodate a user lying on said table, said table having a bottom surface and a perimeter edge, said perimeter edge having a front side, a back side, a first lateral side and a second lateral side, said table being elongated between said front side and said back side;

a plurality of legs, each of said legs being coupled to said table wherein said plurality of legs is configured to support said table over a support surface, each of said legs having an upper end and a lower end, said upper end of each of said legs being coupled to said bottom surface of said table, said plurality of legs including a set of front legs and a set of rear legs, each of said front legs being positioned adjacent to said front side of said perimeter edge of said table, each of said rear legs being positioned adjacent to said back side of said perimeter edge of said table;

a pair of cross members, each of said cross members being coupled to and extending between a respective set of said front legs and rear legs, each of said cross members being positioned between said upper end and said lower end of said respective front legs and rear legs;

a cable support being coupled to each of said plurality of legs such that said cable support is spaced below said table, said cable support having a first end and a second end, said cable support being elongated between said first end and said second end, said cable support having a first bend being spaced from said first end to define a first end portion of said cable support forming an angle with a central portion of said cable support, said cable support having a second bend being spaced from said second end to define a second end portion of said cable support forming an angle with said central portion, said central portion being coupled to each of said cross members such that each of said first end portion and said second end portion angle upwardly toward a respective one of said front side and said back side of said perimeter edge of said table, said central portion of said cable support lying on a plane being oriented parallel to said bottom surface of said table;

a bracket having a first lateral side and a second lateral side, said bracket being integrated into said central portion of said cable support, said bracket having a pair of first engagements each being disposed on said first lateral side, said bracket having a pair of second engagements each being disposed on said second lateral side, said bracket being centrally positioned between said first bend and said second bend on said cable support;

a plurality of pulleys, each of said pulleys being rotatably coupled to said cable support, said pulleys being distributed on opposing ends of said cable support, said plurality of pulleys including a set of first pulleys and a set of second pulleys, each of said first pulleys being positioned on opposing sides of said first end portion of said cable support from each other, each of said first pulleys being positioned adjacent to said first end of said cable support, each of said second pulleys being positioned on opposing sides of said second end portion of said cable support from each other, said second pulleys being spaced apart from each other and being distributed between said second bend and said second end;

a pair of first bands, each of said first bands being coupled to said bracket, each of said first bands extending around respective ones of said first pulleys, each of said first bands being comprised of a resiliently stretchable material, each of said first bands having a first end and a second end;

a pair of first couplers, each of said first couplers being coupled to said first end of a respective one of said first bands, each of said first couplers releasably engaging a respective one of said first engagements and a respective one of said second engagements on said bracket;

a pair of handles, each of said handles being coupled to a respective one of said first bands wherein each of said handles is configured to be gripped with the user's hands thereby facilitating the user to exercise their arms by stretching said first bands, each of said handles having a grip and a yoke, said yoke of each of said grips being releasably coupled to said second end of said respective first band such that said grip is perpendicularly oriented with said respective first band;

a pair of second bands, each of said second bands being coupled to said bracket, each of said second bands extending around respective ones of said second pulleys, each of said second bands being comprised of a resiliently stretchable material, each of said second bands having a first end and a second end;

a pair of second couplers, each of said second couplers being coupled to said first end of a respective one of said second bands, each of said second couplers releasably engaging a respective one of said first engagements and a respective one of said second engagements on said bracket;

a pair of ankle straps, each of said ankle straps being coupled to a respective one of said second bands wherein each of said ankle straps is configured to be worn around a respective one of the user's ankles thereby facilitating the user to exercise their legs with said second bands, each of said ankle straps having an outer surface, said second end of a respective one of said second bands being releasably coupled to said outer surface; and a pair of swivel pulleys, each of said swivel pulleys being disposed on a respective one of said legs, each of said first bands being selectively extendable around said swivel pulleys for adjusting a route taken by said first bands, each of said swivel pulleys including a mount extending laterally away from a respective one of said cross members such that each of said swivel pulleys is spaced outwardly beyond a respective one of said first lateral side and said second lateral side of said perimeter edge of said table.

* * * * *